US005145573A

United States Patent [19]

Riedel et al.

[11] Patent Number: 5,145,573

[45] Date of Patent: Sep. 8, 1992

[54] MARKED MINERAL OILS AND METHOD OF MARKING MINERAL OILS WITH BASIC DYES

[75] Inventors: Guenther Riedel, Heidelberg; Christos Vamvakaris, Kallstadt, both of Fed. Rep. of Germany

[73] Assignee: BASF Aktiengesellschaft, Ludwigshafen, Fed. Rep. of Germany

[21] Appl. No.: 639,594

[22] Filed: Jan. 9, 1991

[30] Foreign Application Priority Data

Jan. 22, 1990 [DE] Fed. Rep. of Germany ..... 4001662

[51] Int. Cl.[5] ..... C10L 1/00

[52] U.S. Cl. ..... 208/14; 208/12; 208/16

[58] Field of Search ..... 208/12, 14, 16

[56] References Cited

U.S. PATENT DOCUMENTS 2,046,365 7/1936 Cassidy et al. ..... 44/9
4,479,899 10/1984 Hamprecht ..... 208/12
4,904,765 2/1990 Derber et al. ..... 534/573

FOREIGN PATENT DOCUMENTS 256460 2/1988 European Pat. Off. .
311790 4/1989 European Pat. Off. .
2129590 12/1971 Fed. Rep. of Germany .
698152 1/1931 France .
361310 11/1931 United Kingdom .
1309903 3/1973 United Kingdom .

*Primary Examiner*—A. Lionel Clingman
*Assistant Examiner*—Mary DiNunzio
*Attorney, Agent, or Firm*—Oblon, Spivak, McClelland, Maier & Neustadt

[57] ABSTRACT

Marked mineral oils containing basic dyes which have at least two, optionally substituted, amino groups and which, on addition of a protogenic acid and, optionally, a metal halide, experience a bathochromic shift of their absorption maximum and an increase in absorbance, and a method of marking mineral oils with basic dyes.

2 Claims, No Drawings

MARKED MINERAL OILS AND METHOD OF MARKING MINERAL OILS WITH BASIC DYES

The present invention relates to marked mineral oils containing, as marking substances, basic dyes which have at least two, optionally substituted, amino groups and which, on addition of a protogenic acid and, optionally, a halide of one of the metals zinc, aluminum and tin, experience a bathochromic displacement of their absorption maximum and an increase in extinction, and to a method of marking mineral oils with basic dyes, in which the basic dyes defined above are used as marking substances.

DE-A 2,129,590 discloses azo dyes of which the diazo component and the coupling component pertain to the aniline series. The radical of the coupling component carries a hydroxyalkyl group which is acetalized. According to EP-A 256,460, these components are suitable, together with oil-soluble dyes, for marking mineral oils. In the detection reaction, acetalized dye is extracted with aqueous mineral acid to cause coloring of the aqueous phase. The drawback of this method is that it is based on the use of an acetalized dye, the preparation of which constitutes an additional process step.

EP-A 311,790 discloses that mineral oil products can be marked with color formers. Color formers are colorless compounds, for example compounds belonging to the class of the lactones, such as crystal violet lactone, fluorane lactones or rhodamine lactones, which produce a color when reacted with acids.

The prior European Patent Application No. 90117781.6 describes oil-soluble azo dyes based on aniline which can also be used for marking mineral oils.

It is an object of the present invention to provide a novel method of marking mineral oils in which basic dyes are to be used as marking substances. A further requirement is that it should be possible to detect the marking substance used in the marked mineral oil in a simple and reliable manner.

Accordingly, we have found the above-defined mineral oils marked with basic dyes.

Suitable basic dyes for use as marking substances in the marked mineral oils of the invention pertain, for example, to the classes of the triarylmethane dyes, the xanthene dyes, the azo dyes and the anthraquinone dyes.

For the purposes of the invention, dyes in the class of the triarylmethane dyes or in the class of the xanthene dyes include their immediate precursors, i.e. in the case of triarylmethane dyes the carbinol compounds, and in the case of xanthene dyes those compounds in which the lactone ring is open but the hydroxy group is still available.

Triarylmethane dyes which may be used as marking substances in the present invention are characterized by the formula I

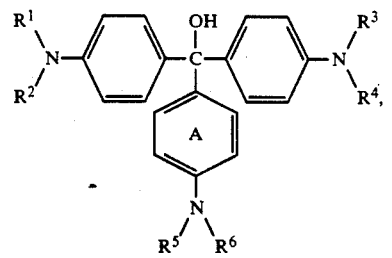

(I)

in which the radicals $R^1$, $R^2$, $R^3$, $R^4$, $R^5$ and $R^6$ are the same or different and independently denote hydrogen, $C_1$–$C_8$-alkyl optionally substituted by hydroxy and optionally interrupted by one or two oxygen atoms, or phenyl and the ring A may be benzoanellated and/or substituted by $C_1$–$C_4$-alkyl, $C_1$–$C_4$-alkoxy or hydrogen.

In the present case the triarylmethane dyes I are shown in the form of the carbinol compounds. As indicated above, this class includes, of course, the corresponding cationic dyes in which the hydroxy group has been removed.

Xanthene dyes which may be used as marking substances in the present invention are characterized, for example, by formula II

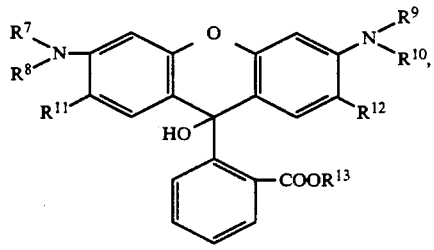

(II)

in which $R^7$ and $R^9$ are the same or different and independently denote $C_1$–$C_4$-alkyl, and $R^8$ and $R^{10}$, $R^{11}$, $R^{12}$ and $R^{13}$ are the same or different and independently denote hydrogen or $C_1$–$C_4$-alkyl.

In this case the xanthene dyes II are shown in the form of the open lactone compounds in which the hydroxy group is still available. As indicated above, this class includes, of course, the corresponding basic dyes in which the hydroxy group has been removed.

Azo dyes which may be used as marking substances in the present invention are characterized, for example, by formula III

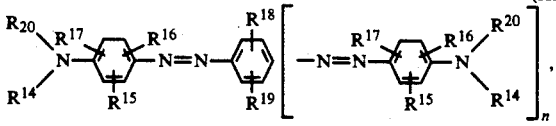

(III)

in which n is equal to 0 or 1, $R^{14}$ and $R^{20}$ are the same or different and independently denote hydrogen or $C_1$–$C_8$-alkyl optionally substituted by hydroxy and optionally interrupted by one or two oxygen atoms, $R^{15}$ and $R^{18}$ are the same different and independently denote hydrogen, $C_1$–$C_4$-alkyl or the radical $NR^{13}R^{14}$, in which $R^{13}$ and $R^{14}$ have the above meanings, and $R^{16}$, $R^{17}$ and $R^{19}$ are the same or different and independently denote hydrogen or $C_1$–$C_4$-alkyl.

Anthraquinone dyes which may be used as marking substances in the present invention are characterized, for example, by formula IV

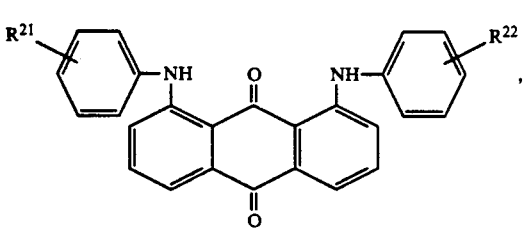

(IV)

in which $R^{21}$ and $R^{22}$ are the same or different and independently denote hydrogen, $C_1$–$C_4$-alkyl, $C_{1-4}$-alkoxy or halogen.

The radicals $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$ and $R^{20}$ are, for example, methyl, ethyl, propyl, isopropyl, butyl, isobutyl or s-butyl.

The radicals $R^1$, $R^2$, $R^3$, $R^4$, $R^5$, $R^6$, $R^{13}$ and $R^{14}$ may additionally be, for example, pentyl, isopentyl, neopentyl, t-pentyl, hexyl, 2-methylpentyl, heptyl, 2-methylhexyl, 2-ethylhexyl, octyl, 2-hydroxyethyl, 2-methoxyethyl, 2-ethoxyethyl, 2-propoxyethyl, 2-butoxyethyl, 2- or 3-hydroxypropyl, 3-hydroxyprop-2-yl, 2- or 3-methoxypropyl, 2- or 3-ethoxypropyl, 2- or 3-propoxypropyl, 2- or 3-butoxypropyl, 2-, 3- or 4-hydroxybutyl, 1-hydroxybut-2-yl, 3-hydroxybut-2-yl, 2- or 4-methoxybutyl, 2-or 4-ethoxybutyl, 2- or 4-propoxybutyl, 2- or 4-butoxybutyl, 3,6-dioxaheptyl, 3,6-dioxaoctyl, 5-hydroxy-3-oxapentyl, 2,5-diethyl-5-hydroxy-3-oxapentyl or 8-hydroxy-3,6-dioxaoctyl.

The radicals $R^{19}$ and $R^{20}$ may additionally be, for example, methoxy, ethoxy, propoxy, isopropoxy, butoxy, isobutoxy, s-butoxy, fluorine, chlorine or bromine.

It is preferred to use, as marking substances, basic dyes in the classes of the triarylmethane dyes, xanthene dyes and azo dyes.

It is particularly preferred to use, as marking substances, basic dyes of the formulae I, II and III.

Particularly noteworthy are mineral oils which contain, as marking substances, basic dyes of formula I, in which $R^1$, $R^2$, $R^3$ and $R^4$ independently denote $C_1$–$C_4$-alkyl, in particular methyl or ethyl, $R^5$ denotes hydrogen or $C_1$–$C_4$-alkyl, in particular hydrogen or methyl, and $R^6$ denotes $C_1$–$C_4$-alkyl or phenyl, in particular methyl or phenyl, and the ring A can be benzoanellated.

Also particularly noteworthy are mineral oils which contain, as marking substances, basic dyes of formula II, in which $R^7$ and $R^9$ independently denote $C_1$–$C_4$-alkyl, in particular methyl or ethyl, and $R^8$, $R^{10}$, $R^{11}$, $R^{12}$ and $R^{13}$ independently denote hydrogen, methyl or ethyl.

Also particularly noteworthy are mineral oils which contain, as marking substances, basic dyes of formula III, in which n is equal to 0 or 1 and $R^{14}$ and $R^{20}$ independently denote hydrogen or $C_1$–$C_4$-alkyl, in particular hydrogen, and $R^{15}$, $R^{16}$, $R^{17}$, $R^{18}$ and $R^{19}$ have the meanings stated above.

The basic dyes used in the method of the invention show a good degree of solubility in mineral oils.

By mineral oils we mean, for example, fuels such as gasoline, kerosene or diesel oil, or oils such as heating oil and engine oil.

The method of the invention is particularly suitable for marking mineral oils which require labelling for tax purposes for example. To minimize the cost of such labelling it is desirable to use, as colorants, dyes having as high a yield as possible. However, even the so-called 'strong' dyes cannot be discerned visually when used to a high degree of dilution in mineral oils.

The novel method has the advantage that the dyes used therein are suitable as labelling substances not only because of their dye characteristics but also because they experience a bathochromic shift of their absorption maximum and an increase in absorbance when there is added thereto a protogenic acid and, optionally, a halide of one of the metals zinc, aluminum and tin.

Suitable protogenic acids for the method of the invention are, in particular, so-called 'strong' acids, i.e. protogenic acids having a pKa value $\leqq 3.5$. Examples of such acids are inorganic or organic acids such as perchloric acid, hydriodic acid, hydrochloric acid, hydrobromic acid, hydrofluoric acid, sulfuric acid, nitric acid, phosphoric acid, benzenesulfonic acid, naphthalenesulfonic acid, methanesulfonic acid, oxalic acid, maleic acid, chloroacetic acid, dichloroacetic acid and bromoacetic acid.

Particularly noteworthy are inorganic acids, of which hydrochloric and sulfuric acids are particularly significant.

Suitable halides of the metals zinc, aluminum and tin are, for example, zinc chloride, zinc bromide, aluminum chloride, aluminum bromide and tin tetrachloride.

Particularly noteworthy is zinc chloride.

The basic dyes are generally used in the form of solutions for marking mineral oils. Suitable solvents are, for example, benzyl alcohol, phenyl ethanol, diethylene glycol monoethyl ether and diethylene glycol monophenyl ether. These solutions are added to the mineral oil. The concentration of basic dye in the marked mineral oil is usually from 10 to 100 ppm. The method of the invention can also be carried into effect on mineral oils which contain other oil-soluble dyes.

The detection of the marking substance contained in mineral oils marked by the method of the invention is very simple, even when the concentration thereof is as low as approx. 0.1 ppm.

As stated above, when the said protogenic acid and, optionally, the said metal halide are added to the marked mineral oil, the basic dye experiences a bathochromic shift of its absorption maximum together with an increase in absorbance. This is manifested by a change of color and an increase in color depth.

It is normally sufficient to shake approximately 20 ml of the mineral oil marked by the method of the invention with 10 ml of an aqueous solution of a protogenic acid, optionally in admixture with the said metal halide, and optionally together with an alcohol such as ethanol, propanol or 1-methoxypropan-2-ol, in order to achieve this color reaction. Alternatively, an aqueous solution of the metal halide may be used alone, since this produces an acid reaction. Here again, an alcohol may be added if desired.

The concentration of the protogenic acid in aqueous solution is usually from 5 to 50% w/w and preferably from 10 to 30% w/w. The concentration of the metal halide is generally from 10 to 20% w/w.

The invention is illustrated below by the following Examples.

GENERAL INSTRUCTIONS

A 25% w/w solution of the basic dye in benzyl alcohol is added to the mineral oil so as to give a concentration of basic dye in the mineral oil of 20 ppm.

20 ml of the mineral oil to be tested are vigorously shaken with 10 ml of detector reagent. The aqueous phase at the bottom shows a distinct change of color. After the two phases have separated and been left to stand for a short period, the colored layer can be compared colorimetrically with a solution of known concentration, so that the dye content can be assessed quantitatively. In this way it is even possible to reliably detect any blending of the marked mineral oil with up to 20 times its volume of unmarked mineral oil.

In the Examples below, the following designations apply:

Dye No.

1 C.I.Basic Orange (11270) in the form of the dye base
2 C.I.Basic Red 1 (45160) in the form of the dye base (hydroxy compound)
3 C.I.Basic Violet 10 (45170) in the form of the dye base (hydroxy compound)
4 C.I.Solvent Violet 8 (42535:1)
5 C.I.Solvent Blue 4 (44045:1) in the form of the dye base
6 C.I.Solvent Blue 2 (42563:1) in the form of the dye base

Detector Reagent

A 10% w/w hydrochloric acid
B 25% w/w aqueous sulfuric acid
C 10% w/w aqueous zinc chloride solution
D 1:1 v/v mixture of A and 1-methoxypropan-2-ol
E 1:1 v/v mixture of B and 1-methoxypropan-2-ol
F 1:1 v/v mixture of C and 1-methoxypropan-2-ol

Mineral oil

Vt=unleaded gasoline
Fb=aviation gasoline
Dt=diesel fuel

| Example No. | Mineral Oil | Dye No. | Detector Reagent | Color appearing on detection |
|---|---|---|---|---|
| 1 | Vt | 1 | A | orange |
| 2 | Vt | 2 | A | orange |
| 3 | Vt | 3 | A | bright red |
| 4 | Fb | 1 | B | orange |
| 5 | Vt | 2 | B | orange/red |
| 6 | Fb | 3 | B | orange |
| 7 | Dt | 3 | C | pink |
| 8 | Dt | 1 | D | orange |
| 9 | Dt | 1 | E | orange |
| 10 | Dt | 1 | F | orange |
| 11 | Fb | 2 | D | red |
| 12 | Fb | 2 | E | red |
| 13 | Fb | 2 | F | red |
| 14 | Vt | 3 | D | pink |
| 15 | Vt | 3 | E | pink |
| 16 | Vt | 3 | F | pink |
| 17 | Vt | 5 | D | blue |
| 18 | Vt | 5 | E | blue |
| 19 | Vt | 5 | F | blue |
| 20 | Dt | 6 | D | blue |
| 21 | Dt | 6 | E | blue |
| 22 | Dt | 6 | F | blue |
| 23 | Vt | 4 | D | blue |

We claim:

1. A marked mineral oil composition comprising a mineral oil and, as a marking substance, a basic dye having the formula (III)

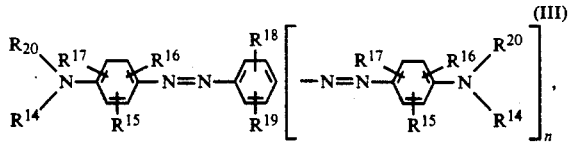

(III)

in which n is equal to 0 or 1, $R^{14}$ and $R^{20}$ are the same or different and independently are hydrogen or $C_1$–$C_8$-alkyl optionally substituted by hydroxy and optionally interrupted by one or two oxygen atoms, $R^{15}$ and $R^{18}$ are the same or different and independently are hydrogen, $C_1$–$C_4$-alkyl or the radical $NR^{13}R^{14}$, in which $R^{13}$ is hydrogen or $C_1$–$C_4$-alkyl and $R^{14}$ has the above meaning, and $R^{16}$, $R^{17}$ and $R^{19}$ are the same or different and independently are hydrogen or $C_1$–$C_4$-alkyl, and formula (IV)

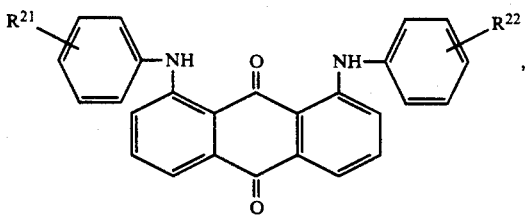

(IV)

in which $R^{21}$ and $R^{22}$ are the same or different or are independently hydrogen, $C_1$–$C_4$-alkyl, $C_1$–$C_4$-alkoxy or halogen, said basic dye, on addition of a protogenic acid and, optionally, a halide of zinc, aluminum, or tin, experiencing a bathochromic shift of its absorption maximum and an increase in absorbance, wherein said composition contains an amount of said basic dye such that the composition is substantially colorless prior to treatment by addition of a protogenic acid and, optionally, a halide of zinc, aluminum, or tin, whereupon said basic dye experiences a bathochromic shift of its absorption maximum and an increase in absorbance, and wherein the amount of said basic dye is from about 0.1 to about 100 parts per million.

2. A method of marking mineral oils comprising adding to said mineral oils a marking substance which is a basic dye having the formula (III)

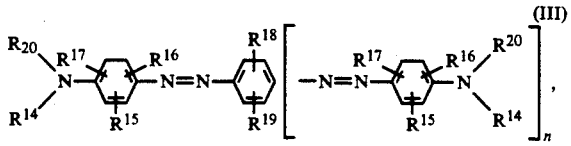

(III)

in which n is equal to 0 or 1, $R^{14}$ and $R^{20}$ are the same or different and independently are hydrogen or $C_1$–$C_8$-alkyl optionally substituted by hydroxy and optionally interrupted by one or two oxygen atoms, $R^{15}$ and $R^{18}$ are the same or different and independently are hydrogen, $C_1$–$C_4$-alkyl or the radical $NR^{13}R^{14}$, in which $R^{13}$ is hydrogen or $C_1$–$C_4$-alkyl and $R^{14}$ has the above meaning, and $R^{16}$, $R^{17}$ and $R^{19}$ are the same or different and independently are hydrogen or $C_1$–$C_4$-alkyl, or the formula (IV)

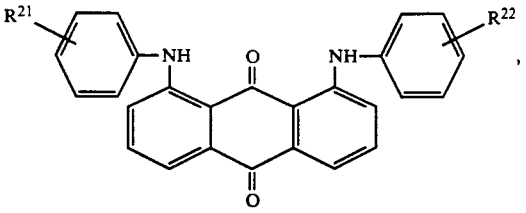

(IV)

in which $R^{21}$ and $R^{22}$ are the same or different and are independently hydrogen, $C_1$–$C_4$-alkyl, $C_1$–$C_4$-alkoxy or halogen, and which, on addition of a protogenic acid and, optionally, a halide of one of the metals zinc, aluminum, or tin, experiences a bathochromic shift of its absorption maximum and an increase in absorbance, wherein said basic dye is added in an amount such that the marked mineral oil composition is substantially colorless prior to addition of a protogenic acid and, optionally, said halide of zinc, aluminum or tin, whereupon said basic dye experiences a bathochromic shift of its absorption maximum and an increase in absorbance such as to result in imparting a visible color to the composition, and wherein the amount of said basic dye added constitutes from about 0.1 to 100 parts per million of said marked mineral oil composition.

* * * * *